United States Patent [19]

Doyel

[11] 3,942,272

[45] Mar. 9, 1976

[54] MODULAR FRAME FOR STRETCHING SHEET MATERIAL SUITABLE FOR HOME USE IN HOBBY ACTIVITIES

[76] Inventor: John S. Doyel, 404 W. 20th St., New York, N.Y. 10011

[22] Filed: June 16, 1975

[21] Appl. No.: 587,280

[52] U.S. Cl. ..... 38/102.91; 38/102.5

[51] Int. Cl.[2] ..... D06C 3/08

[58] Field of Search ..... 101/127.1; 160/371–380, 382, 399, 402, 403; 38/102–102.91

[56] References Cited

UNITED STATES PATENTS

| | | | |
|---|---|---|---|
| 2,456,225 | 12/1948 | Thomas | 38/102.91 |
| 3,830,278 | 8/1974 | Packer | 160/378 |
| 3,841,008 | 10/1974 | Cusick | 38/102.91 |
| 3,878,629 | 4/1975 | Grube | 38/102.91 |

*Primary Examiner*—G. V. Larkin

*Attorney, Agent, or Firm*—Cooper, Dunham, Clark, Griffin & Moran

[57] ABSTRACT

Disclosed is a modular, collapsible and adjustable rectangular frame for stretching sheet material which is particularly adapted for use in hobby activities such as rug-tufting. The basic frame comprises four identical side bars and four identical legs. Each of the side bars and legs is integrally molded of a substantially homogeneous material such as a thermoplastic material. Additionally, there are extension bars each of which is also integrally molded of a substantially homogeneous material. Each of the side and extension bars has a connecting insert extending away from the bar at one end thereof and a corresponding connecting tunnel extending into the other end. The frame is assembled by frictionally fitting the connecting insert of one bar into the connecting tunnel of another bar to form a rectangle and by frictionally fitting each leg into a corresponding leg tunnel of each side of the rectangle. The size and shape of the frame is changed by adding or subtracting extension bars. Sheet material, such as fabric, is stretched by lacing the material over the frame by a web secured on suitable web engaging projections extending away from the frame from each bar.

5 Claims, 6 Drawing Figures

Fig. 1.
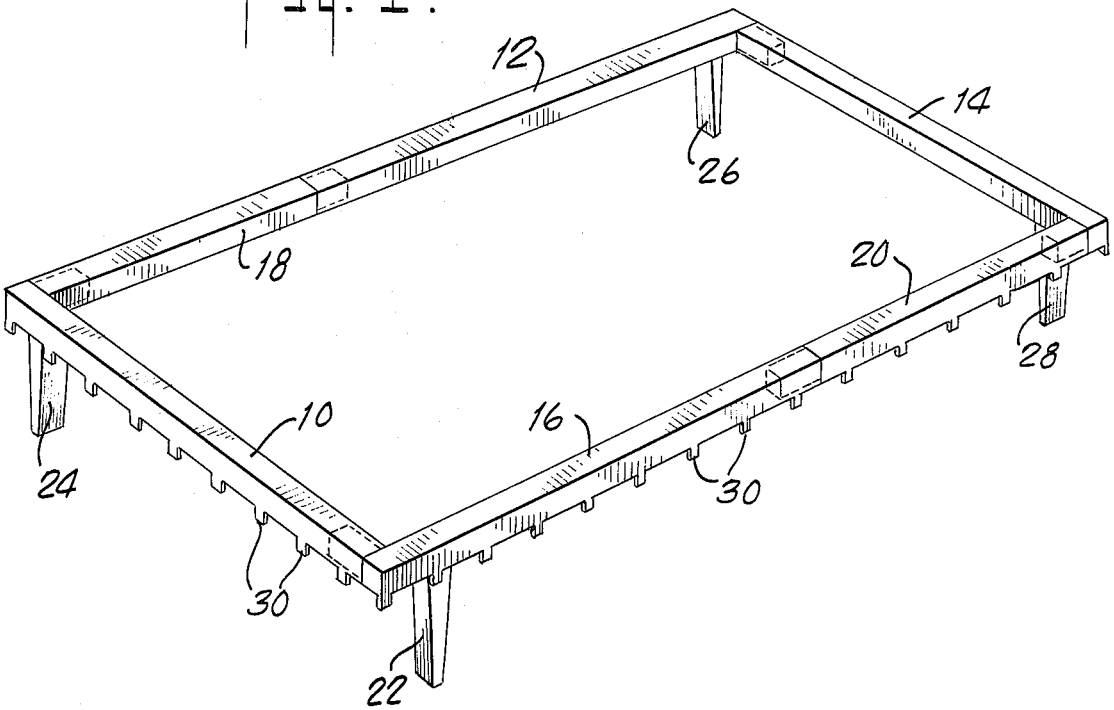
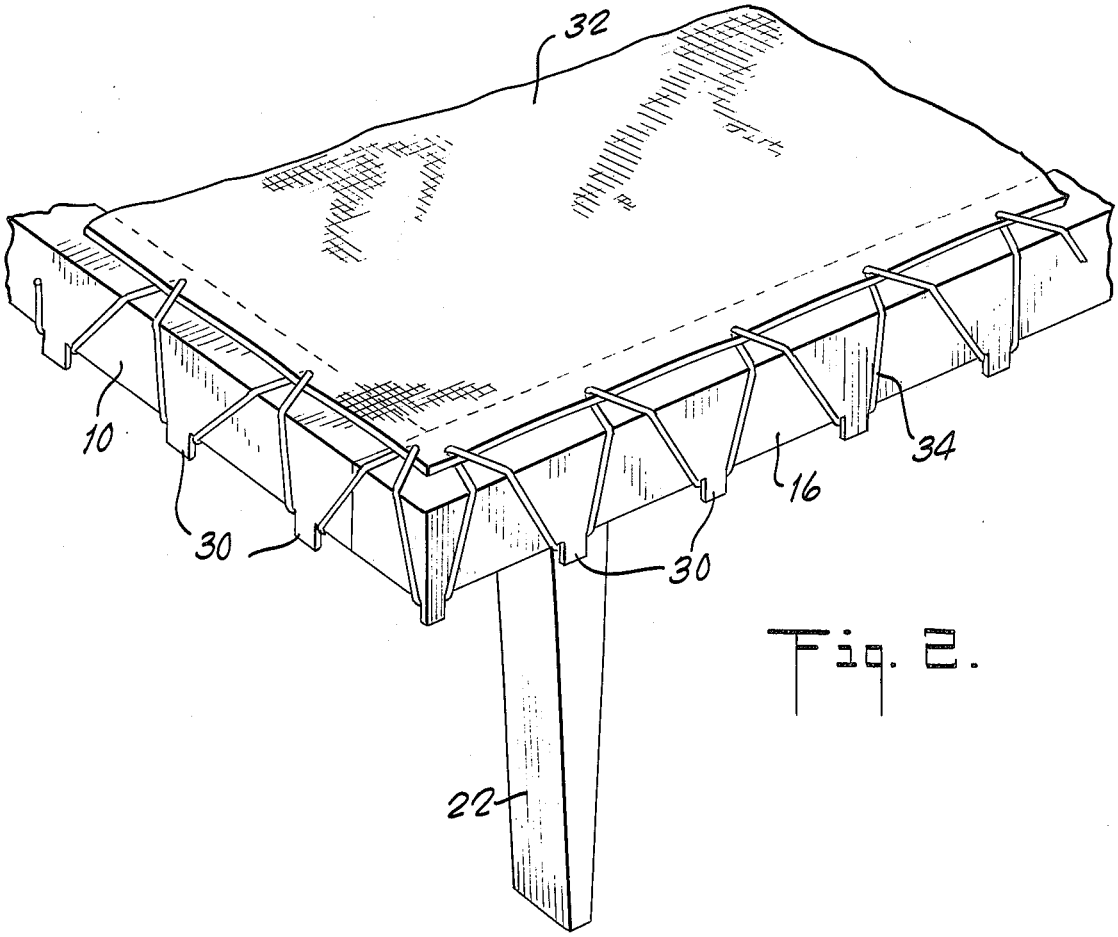
Fig. 2.

MODULAR FRAME FOR STRETCHING SHEET MATERIAL SUITABLE FOR HOME USE IN HOBBY ACTIVITIES

BACKGROUND AND SUMMARY OF THE INVENTION

The invention is in the field of collapsible frames for stretching sheet material and is specifically directed to a frame of this type which is suitable for home use by hobbyists in fields such as rug-tufting. A particular object of the invention is to provide a frame of this type which is modularly made of repeating, identical pieces that can be inexpensively manufactured by processes such as molding of a thermoplastic material.

In hobby activities, such as making a rug on a burlap base with a rug-tufting needle, it is necessary to stretch the burlap tightly so that it can be easily pierced by the tufting needle to form loops of yarn at the side opposite the side from which it is pierced. Stretching frames to accommodate needs of this type can be and have been made in a variety of ways. For example, burlap has been stretched on canvas frames of the type used for paintings, or on collapsible rectangular frames comprising four sides connected at the corners of the rectangle by screws or nails, or on other similar frames. However, none of the frames of this type known to the inventor herein satisfactorily meet all of the essential requirements for hobby uses, which include easy assembly and disassembly of the frame, compact size for convenient storage when not in use, lightness so the frame can be easily moved from place to place, structural strength so that the sheet material can be stretched tightly, convenient provisions for stretching the sheet material, ease of changing the size of the frame, and the like. This invention is directed to meeting these diverse and sometimes conflicting requirements.

A specific embodiment of the invention comprises a modular, collapsible and adjustable rectangular frame for stretching sheet material, as for rug-tufting by a hobbyist. The frame includes four substantially identical side bars extending along the sides of a horizontal rectangle, at least two substantially identical extension bars extending along at least two opposite sides of the rectangle, and four substantially identical legs extending downwardly from each of the sides of the rectangle. Each bar is integrally formed of a substantially homogeneous material and comprises: an elongated channel member which is substantially rectangular in a vertical section transverse to the length of the bar and is formed of a top and two side walls; a substantially shorter bottom wall at one longitudinal end of the channel member which forms, together with the adjacent portion of the top and side walls a connecting tunnel which is open longitudinally outwardly; a connecting insert extending away from the channel member at the other longitudinal end thereof, said insert being shaped and dimensioned to be received in frictional fit in said connecting tunnel; and a longitudinally extending row of spaced bracing walls each extending transversely of the top and side walls and being integral therewith. A selected pair of adjacent bracing walls form, together with the portions of the top and side walls intermediate thereto, a leg tunnel which is substantially rectangular in horizontal section. The side wall facing away from the frame has at its lower portion a longitudinally extending row of web-engaging projections facing away therefrom. The connecting insert of each side bar extends transversely of the length of the channel member thereof and the connecting insert of each extension bar extends along the length of the channel member thereof. Each leg is integrally formed of a substantially homogeneous material and comprises an upper tubular portion which is substantially rectangular in horizontal section and is dimensioned and shaped to be slidably received in frictional fit from below into a leg tunnel, and a tapered lower portion. The frame is assembled by frictionally fitting the connection insert of each bar into the connecting tunnel of another bar to form a rectangular frame, and by frictionally fitting each leg into a leg tunnel of each side of the rectangular frame. Sheet material is stretched by laying the material over the frame and pulling outwardly the marginal portion thereof by a web laced through the material and lacing said web-engaging projections. The length of any pair of opposite sides of the frame is changed by adding or subtracting extension bars.

DESCRIPTION OF THE DRAWINGS

FIG. 1 is a perspecive view of an assembled frame embodying the invention;

FIG. 2 is a perspective view of a portion of the frame shown in FIG. 1, illustrating the manner of lacing sheet material stretched thereon;

DETAILED DESCRIPTION

Figure 3:
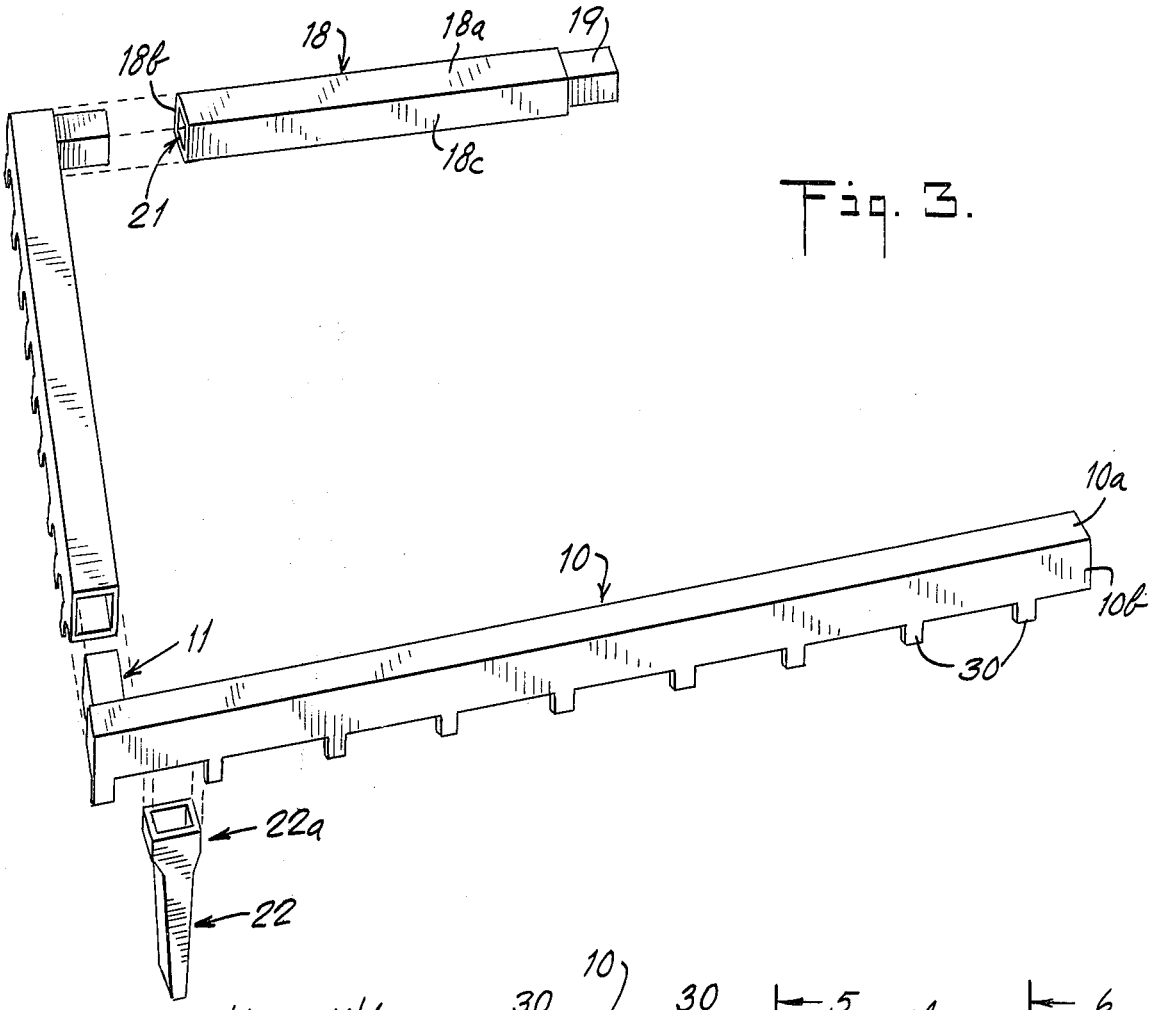
FIG. 3 is an exploded perspective view of a portion of the frame shown in FIG. 1.

Referring to FIG. 1, the frame comprises: (1) four substantially identical side bars 10, 12, 14 and 16 extending along the four sides of a horizontal rectangle, (2) two substantially identical extension bars 18 and 20 extending along two opposite sides of the rectangle, and (3) four substantially identical legs 22, 24, 26 and 28 each extending downwardly from a different side of the rectangle. Each of the side walls of the bars which faces away from the frame has along the length thereof a row of web-engaging projections 30 which are used, as illustrated in FIG. 2, to lace a sheet material 32, such as burlap, with a web 34 threaded through the material 32, laced over the web-engaging projections 34 and tightened to thereby tighten the sheet material 32. Note that orientation terms, such as horizontal, up, down, etc., are used to describe the frame as shown in FIG. 1, assuming that the bars are in a horizontal plane, and the legs are below the bars, but that this in no way limits the manner in which the frame may be oriented in use.

Figure 4:
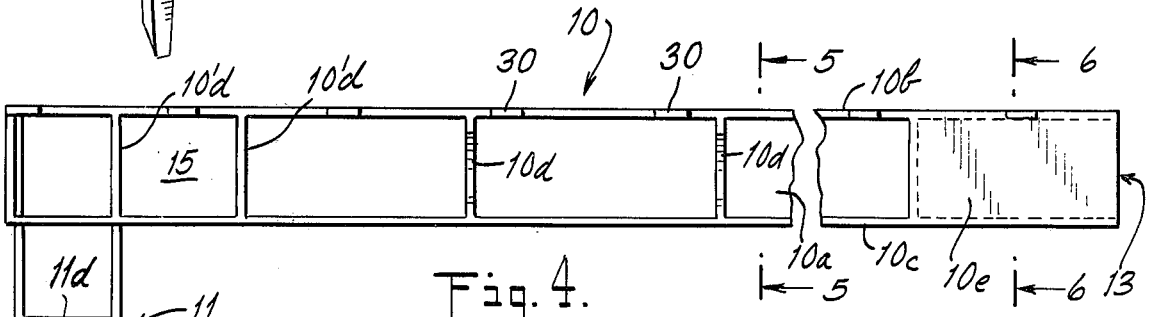
FIG. 4 is a bottom, partly elevational and partly sectional view of an exploded portion of the frame.
Figure 6:
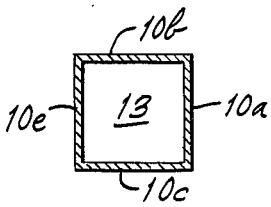
FIG. 6 is a sectional view taken along line 6—6 of FIG. 4.

Each of the bars 10–20 is integrally formed of a substantially homogeneous material, as by molding a thermoplastic material in a mold. Referring to FIGS. 3 and 4, the side bar 10 comprises a channel member formed of a top wall **10*a*, and outer side wall 10*b* and an inner side wall 10*c* which are braced by a row of bracing walls 10*d* that extends along the length of the channel member, with each bracing wall being transverse to the top and side walls and integral therewith. At one longitudinal end of the side bar 10, there is a connecting insert 11 extending transversely of the major portion of the bar 10 toward the opposite side of the rectangular frame. The connecting insert 11 is similar in shape to the major portion of the bar 10, in that it is formed of a channel member having a top wall 11***a*, an outer side wall 11*b*, an inner side wall 11*c* and a pair of bracing walls 11*d*. The connecting insert 11 tapers slightly as it extends from the major portion of the side bar 10, and its outside horizontal dimension is slightly less than the distance between the side walls 10*b* and 10*c* of the bar 10, so that it can be received in frictional fit therebetween. At the longitudinal end of the bar 10 which is opposite the connecting insert 11 there is a short bottom wall 10*e*, whose length is about equal to the length of the insert 11. As best seen in FIGS. 4 and 6, the short bottom wall 10*e* forms, together with the adjacent portions of the side walls 10*b* and 10*c* and of the top walls 10*a*, a connecting tunnel 13 which is open on the side facing longitudinally outwardly of the side bar 10. The vertical dimension of the connecting insert 11 is slightly less than the vertical dimension of the connecting tunnel 13, whereby the insert 11 can be received frictionally within the tunnel 13. The remaining three side bars 12, 14, and 16 are substantially identical to the side bar 10, and are not described in detail individually.

Each of the extension bars 18 and 20 is similar to the side bar 10, differing only in that the overall length thereof may be different and in that the connecting insert of each extension bar extends longitudinally outwardly along the length of the extension bar, as opposed to the insert 11 which extends transversely of the length of the major portion of the side bar 10. Referring to FIGS. 3 and 4, the extension bar 18 comprises a top wall 18*a*, an outer side wall 18*b* and an inner side wall 18*c*. These three walls form a channel member strenghtened with bracing walls 18*d* which are similar to the corresponding bracing walls 10*d* of the side bar 10. Additionally, the extension bar 18 has, at one longitudinal end, a connecting insert 19 which is substantially identical in shape and size to the connecting insert 11 of the side bar 10 but extends coaxially longitudinally outwardly of the extension bar 18. At the longitudinal end of the extension bar 18 opposite the connecting insert 19 there is a connecting tunnel 21 formed of a short bottom wall 18*e* and the adjacent portion of the top wall 18*a* and the side walls 18*b* and 18*c*. The connecting tunnel 21 is of the same size and shape as the connecting tunnel 13 of the side bar 10. The outer side wall 18*b* has a longitudinally extending row of web-engaging projections 30 which are the same as the projections 30 of the side bar 10. The other extension bar 20 is substantially identical to the extension bar 18, and is not individually described in detail.

The side walls of the bars are not exactly parallel to each other; they are somewhat closer at the top ends, whereby there is a taper in going from below toward the top wall. Similarly, the connecting inserts taper away from the corresponding bars and the connecting tunnels taper correspondingly into the bars. These tapers facilitate the manufacture of the frame by a molding process and facilitate assembly and disassembly of the frame.

The legs 22, 24, 26 and 28 are integrally made of a substantially homogeneous material, such as by a thermoplastic molding process. Referring to FIG. 3, the leg 22 comprises an upper tubular portion 22a which is substantially rectangular in horizontal section and is shaped and dimensioned to be slidably received in frictional fit in a leg tunnel formed between the side walls of a bar and two adjacent bracing walls of a bar.

Figure 5:
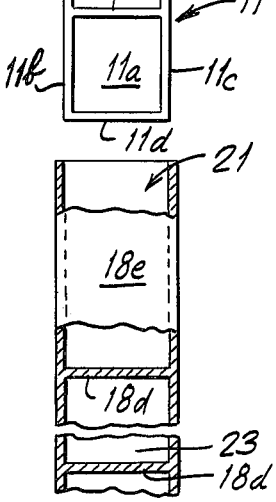
FIG. 5 is a sectional view taken along line 5—5 of FIG. 4.
Figure 5:
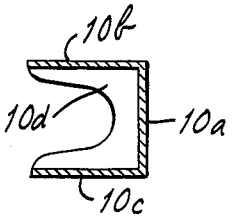

Referring to FIGS. 3 and 4, the bracing walls 10'*d* of the side bar 10 are closer to each other than the other bracing walls 10d, and define, together with the intermediate portion of the side walls 10*b* and 10*c* and the top wall 10*a*, a leg tunnel 15 whose horizontal sectional area is slightly larger than the horizontal sectional area of the upper portion 22*a* of the leg 22 so as to receive said upper portion of the leg 22 in a frictional fit. The bracing walls 10'*d* may extend downwardly to the level of the bottom of the side walls 10*b* and 10*c*, as opposed to the remaining bracing walls 10*d* which, as seen in FIG. 5, may curve upwardly, away from the bottoms of the side walls 10*b* and 10*c*. The remaining legs 24, 26 and 28 are substantially identical to the leg 22 and are not individually described in detail. Each fits into a corresponding leg tunnel either of another side bar or into a similar leg tunnel 23 (FIG. 4) of an extension bar.

The frame is stored disassembled, with each connecting insert being out of its corresponding connecting tunnel and with each leg being out of its corresponding leg tunnel. To assemble the frame for use, the four side bars 10, 12, 14 and 16 are laid along the sides of a rectangle, and any extension bars that may be needed are laid in pairs along opposite sides of the rectangle. It should be clear that a frame may be assembled without any extension bars, only with the side bars, and that more than two extension bars may be used to enlarge the size of the frame. It should also be clear that several pairs of extension bars, each of a different length, may be provided with the basic frame so as to enable users to assemble frames of varying sizes. When the desired number of bars have been laid along the sides of the rectangle, each connecting insert is slidably fitted frictionally into the facing connecting tunnel to form a rectangular frame of the type shown in FIG. 1. The four legs are fitted into the corresponding leg tunnels adjacent the corners of the frame. A piece 32 of a sheet material such as burlap is then laced (perhaps with the help of a needle) with a web 34 in the manner illustrated in FIG. 2.

The invented frame can be inexpensively manufactured, and is particularly easy to assemble and disassemble. It is lightweight and can be easily stored, and it has high structural strength to enable a piece of sheet material to be stretched tightly. The fact that only three different integral pieces are used in the frame, (a side bar, an extension bar, and a leg) means that only three different molding cavities need to be made, which substantially reduces the cost of making a mold for the invented frame and of manufacturing the invented frame. Further, the fact that the connecting inserts and tunnels are identical simplifies the design of the mold and the assembly and disassembly of the frame. Moreover, the specific arrangement of the frame elements described above, and particularly the relative arrangement of the connecting tunnels and inserts and of the leg tunnels and legs make it possible to mold the elements of the invented frame by a process such as injection molding, and thus simplifies the manufacture of the invented frame and reduces the cost thereof.

I claim:

1. A modular, collapsible and adjustable rectangular frame for stretching sheet material, as for rug-tufting by a hobbyist, comprising:

four substantially identical side bars extending along the sides of a horizontal rectangle, at least two substantially identical extension bars extending along at least two opposite sides of the rectangle, and four substantially identical legs extending downwardly from each of the sides of the rectangle, wherein:

each bar is integrally formed of a substantially homogeneous material and comprises: an elongated channel member which is substantially rectangular in a vertical section transverse to the length of the bar and is formed of a top and two side walls; a substantially shorter bottom wall at one longitudinal end of the channel member which forms, together with the adjacent portion of the top and side walls, a connecting tunnel which is open longitudinally outwardly; a connecting insert extending away from the channel member at the other longitudinal end thereof, said insert being shaped and dimensioned to be received in frictional fit in said connecting tunnel; a longitudinally extending row of spaced bracing walls each extending transversely of the top and side walls and being integral therewith; a selected pair of adjacent bracing walls forming, together with the portion of the top and side walls intermediate thereto, a leg tunnel which is substantially rectangular in horizontal section; the side wall facing away from the frame having at its lower portion a longitudinally extending row of web-engaging projections facing away therefrom, the connecting insert of each side bar extending transversely of the length of the channel member thereof and the connecting insert of each extension bar extending along the length of the channel member thereof; and each leg is integrally formed of a substantially homogeneous material and comprises an upper tubular portion which is substantially rectangular in horizontal section and is dimensioned and shaped to be slidably received in frictional fit from below into a leg tunnel formed between the side walls of each of said channel members and two adjacent bracing walls thereof;

wherein the frame is assembled by frictionally fitting the connecting insert of each bar into the connecting tunnel of another bar to form a rectangular frame and by frictionally fitting each leg into a leg tunnel of each side of the rectangular frame, sheet material is stretched thereon by laying the material over the frame and pulling outwardly the marginal portion thereof by a web lacing said web-engaging projections, and the lengths of any pair of opposite sides of the frame are changed by adding or subtracting extension bars.

2. A frame as in claim 1 wherein each connecting insert tapers as it extends away from the bar integral therewith and each connecting tunnel tapers correspondingly as it extends into a bar.

3. A frame as in claim 2 wherein the side walls of a bar are closer to each other at the top wall integral therewith than at the bottoms thereof.

4. A frame as in claim 1 wherein the web-engaging projections of each bar are coplanar with the side wall of the bar which faces away from the frame and extend downwardly from the last recited side wall.

5. A modular, collapsible and adjustable rectangular frame for stretching sheet material, as for rug-tufting by a hobbyist, comprising:

four substantially identical side bars extending along the sides of a horizontal rectangle and four substantially identical legs extending downwardly from each of the sides of the rectangle, wherein:

each side bar is integrally formed of a substantially homogeneous material and comprises: an elongated channel member which is substantially rectangular in a vertical section transverse to the length of the bar and is formed of a top and two side walls; a substantially shorter bottom wall at one longitudinal end of the channel member which forms, together with the adjacent portion of the top and side walls, a connecting tunnel which is open longitudinally outwardly and tapers inwardly; a connecting insert extending away from the channel member at the other longitudinal end thereof, said insert being tapered outwardly and shaped and dimensioned to be received in frictional fit in said connecting tunnel; a longitudinally extending row of spaced bracing walls each extending transversely of the top and side walls and being integral therewith; a selected pair of adjacent bracing walls forming, together with the portions of the top and side walls intermediate thereto, a leg tunnel which is substantially rectangular in horizontal section; the side wall facing away from the frame having at its lower portion a longitudinally extending row of web-engaging projections facing away therefrom; the connecting insert of each side bar extending transversely of the length of the channel member thereof; and each leg is integrally formed of a substantially homogeneous material and comprises an upper tubular portion which is substantially rectangular in horizontal section and is dimensioned and shaped to be slidably received in frictional fit from below into a leg tunnel, each leg fitting into a different side wall;

wherein the frame is assembled by frictionally fitting the connecting insert of each side bar into the connecting tunnel of another side bar to form a rectangular frame and by frictionally fitting each leg into a leg tunnel of each side of the rectangular frame, and sheet material is stretched thereon by laying the material over the frame and pulling outwardly the marginal portion thereof by a web lacing said web-engaging projections of the side bars.

* * * * *